United States Patent [19]

Mima

[11] Patent Number: 4,555,899

[45] Date of Patent: Dec. 3, 1985

[54] SPUN YARN SPLICING DEVICE

[75] Inventor: Hiroshi Mima, Kyoto, Japan

[73] Assignee: Murata Kikai Kabushiki Kaisha, Japan

[21] Appl. No.: 437,268

[22] Filed: Oct. 28, 1982

[30] Foreign Application Priority Data

Oct. 29, 1981 [JP] Japan ..... 56-173574

[51] Int. Cl.[4] ..... B65H 69/06; D01H 15/00; D02J 1/08

[52] U.S. Cl. ..... 57/22; 57/261

[58] Field of Search ..... 57/22, 23, 202, 261–263

[56] References Cited

U.S. PATENT DOCUMENTS

| | | | |
|---|---|---|---|
| 4,240,247 | 12/1980 | Matsui et al. | 57/22 X |
| 4,246,744 | 1/1981 | Matsui et al. | 57/22 |
| 4,363,775 | 4/1981 | Mima | 57/22 |
| 4,419,858 | 12/1983 | Rohner et al. | 57/22 |
| 4,424,663 | 1/1984 | Rohner et al. | 57/22 |
| 4,438,621 | 3/1984 | Rohner | 57/22 |
| 4,452,035 | 6/1984 | Rohner et al. | 57/22 |

FOREIGN PATENT DOCUMENTS

| | | | |
|---|---|---|---|
| 956992 | 4/1964 | United Kingdom | 57/22 |

*Primary Examiner*—John Petrakes

*Attorney, Agent, or Firm*—Spensley Horn Jubas & Lubitz

[57] ABSTRACT

A spun yarn splicing device comprises a yarn splicing member having a yarn splicing hole, a fluid ejection nozzle for ejecting compressed fluid into the yarn splicing hole, and a slit opening into the yarn splicing hole for guiding yarn ends to be spliced into the yarn splicing hole, the yarn splicing hole being cylindrical in a cross section, the slit being directed tangentially to the yarn splicing hole and connected thereto at a junction, the fluid ejection nozzle opening toward a central axis of the yarn splicing hole adjacent to the junction and having a cross-sectional shape elongated in an axial direction of the yarn splicing hole. The yarn ends in the yarn splicing hole can be spliced together by the compressed fluid introduced from the fluid ejection nozzle into the yarn splicing hole.

8 Claims, 20 Drawing Figures

SPUN YARN SPLICING DEVICE

BACKGROUND OF THE INVENTION

The present invention relates to a pneumatic spun yarn splicing device.

The pneumatic yarn splicing device having a yarn splicing member with a yarn splicing hole extending transversely between its side face is disclosed, for example, in U.S. Pat. No. 4,263,775. Yarn ends to be spliced together are untwisted and introduced into the yarn splicing hole in which the yarn ends are twisted and twined into a joined yarn by a stream of compressed fluid flowing into the yarn splicing hole. The fluid stream ejected against the yarn ends however tends to swirl in the yarn splicing hole. By the circular movement of the stream, the yarn ends are brought into contact with the wall surface of the yarn splicing hole to cause their outer fibers to be intertwined. However, the yarn joints which are prepared by turning yarn ends around in the splicing hole is slightly poor in strength.

SUMMARY OF THE INVENTION

It is an object of the present invention to provide a spun yarn splicing device for splicing yarn ends into a yarn joint having a strength comparable to that of the rest of the yarn.

According to the present invention, a spun yarn splicing device comprises a yarn splicing member having a yarn splicing hole, a fluid ejection nozzle for ejecting compressed fluid into the yarn splicing hole, and a slit opening into the yarn splicing hole for guiding yarn ends to be spliced into the yarn splicing hole, the yarn splicing hole being cylindrical in a cross section, the slit being directed tangentially to the yarn splicing hole and connected thereto at a junction, the fluid ejection nozzle opening toward a central axis of the yarn splicing hole adjacent to the junction and having a cross-sectional shape elongated in axial direction of the yarn splicing hole. The yarn ends in the yarn splicing hole can be spliced together by the compressed fluid introduced from the fluid ejection nozzle into the yarn splicing hole for enabling yarn fibers to be intertwined strongly.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 2:
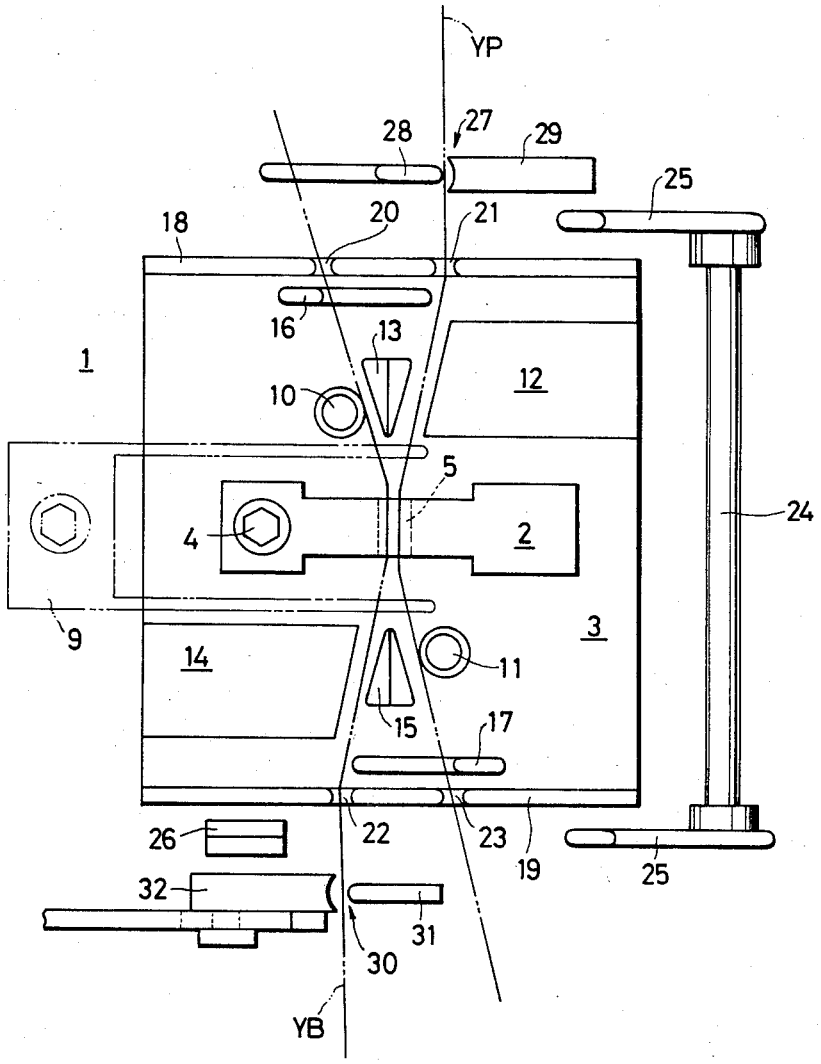
FIG. 2 is a front elevational view of the spun yarn splicing device.
Figure 5:
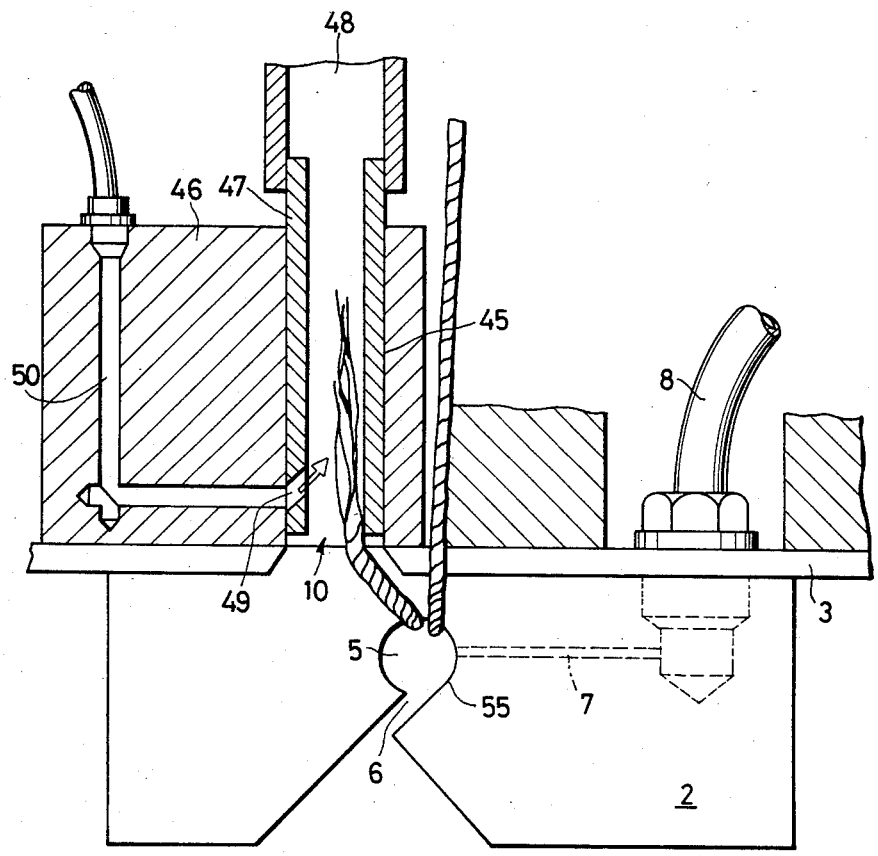
FIG. 5 is an enlarged view of a yarn splicing member and a control nozzle.
Figure 12:
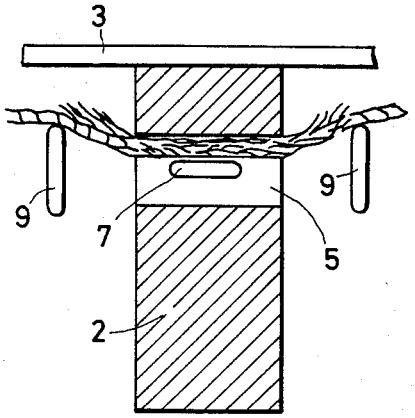
FIGS. 12 through 18 are enlarged cross-sectional views of the yarn splicing hole.

As shown in FIG. 2, a yarn splicing member 2 is fixed by a screw 4 to a bracket 3 substantially centrally on a yarn splicing device 1, the yarn splicing member 2 having a central cylindrical yarn splicing hole 5. In FIG. 5, the yarn splicing member 2 includes a slit 6 extending tangentially to the yarn splicing hole 5 for inserting a yarn into the yarn splicing hole 5 from the exterior. The yarn splicing member 5 has a fluid ejection nozzle 7 opening toward the center of the yarn splicing hole 5 adjacent to a junction 55 between the yarn splicing hole 5 and the slit 6. As illustrated in FIG. 12, the fluid ejection nozzle 7 has a cross-sectional shape elongated in the axial direction of the yarn splicing hole 5. The air ejection nozzle 7 is supplied with fluid from a source of compressed fluid (not shown) through a conduit 8. A pair of yarn presser levers 9, 9 are disposed on each side of the yarn splicing member 2 for positioning yarn ends in mutual contact within the yarn splicing hole 5 in diametrically opposite relation to the slit 6 prior to yarn splicing, and for assuring first twining of the yarn ends when fluid is ejected under pressure from the fluid ejection nozzle 7 at an initial stage. On both sides of the yarn splicing member 2, there are provided a pair of control nozzles 10, 11, yarn guides 12, 13, 14, 15, a pair of yarn cutters 16, 17, and a pair of fork guides 18, 19. A pair of swingable yarn handler levers 25, 25 are fixed to a support shaft 24 at its ends alongside of the yarn splicing member 2. One of the yarn handler levers 25 can be stopped in movement by a stopper 26. A clamp unit 30 comprises a lever 31 and a movable clamp plate 32 for clamping a yarn end YB on the bobbin side. A clamp unit 27 comprises a swing lever 28 and a spring-loaded clamp plate 29 for clamping a yarn end YP on the package side.

Since the control nozzles 10, 11 are of the same configuration, one of the control nozzles 10 will be described. In FIG. 5, a nozzle hole 45 is defined through a block 46 and receives a tubular nozzle pipe 47 axially slidably fitted therein. The nozzle pipe 46 is coupled to a flexible pipe 48 joined to a suction pipe (not shown). The nozzle pipe 47 has an inclined fluid ejection aperture 49 adjacent to an open end thereof and directed away from the open end. The fluid ejection aperture 49 communicates through an air passage 50 in the block 46 with a compressed fluid conduit (not illustrated).

Figure 1:
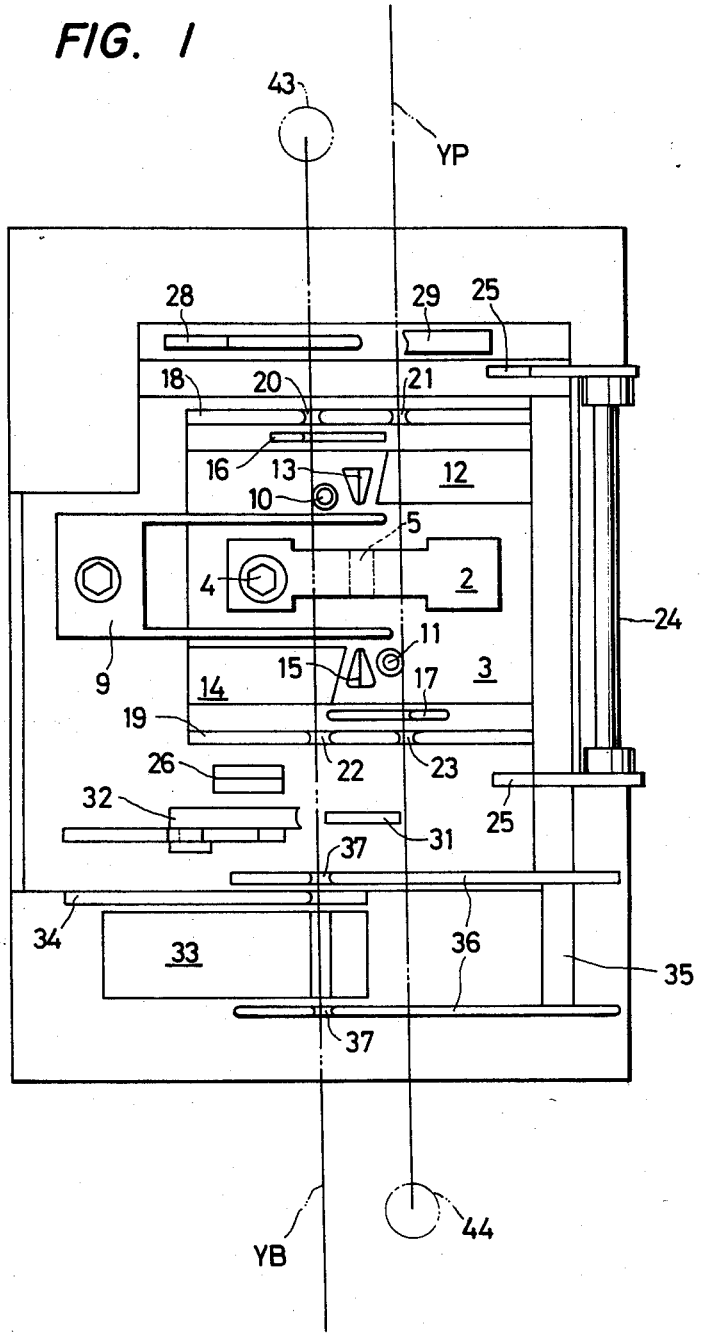
FIG. 1 is a front elevational view of a spun yarn splicing device and a yarn detector.
Figure 3:
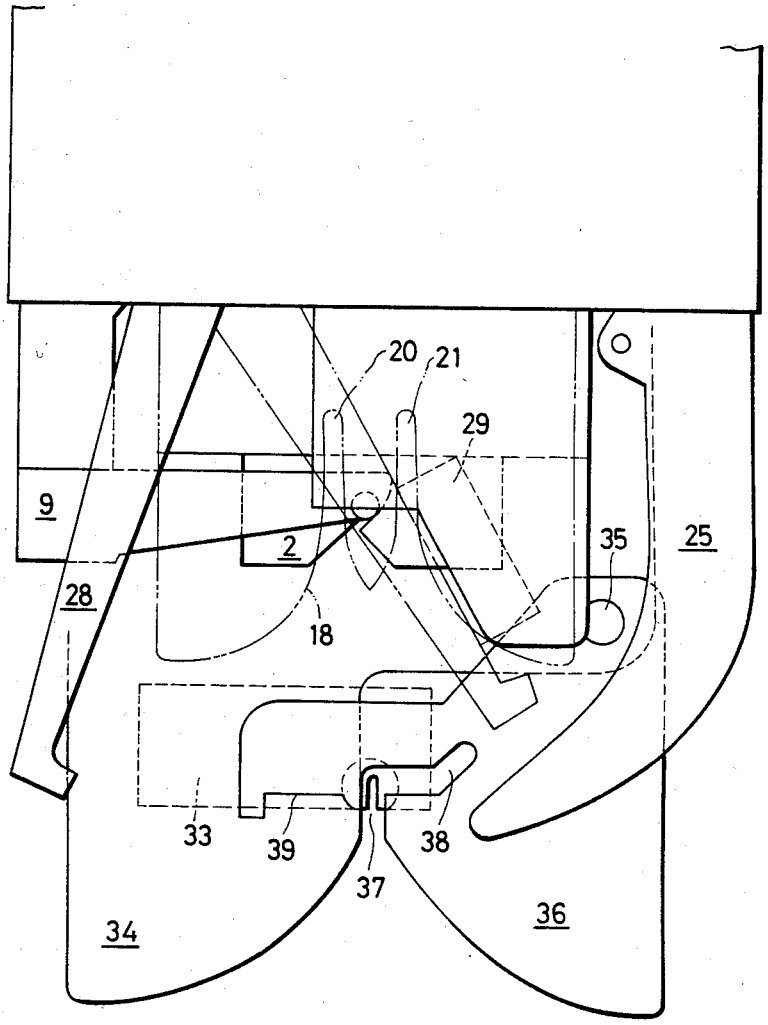
FIGS. 3 and 4 are plan views of the spun yarn splicing device and the yarn detector shown in FIG. 1.

As shown in FIG. 1, a yarn detector 33 is disposed downwardly of the clamp unit 30, and a pair of switch levers 36, 36 are supported on a pivot shaft 35 in sandwiching relation to the yarn detector 33. A fixed guide plate 34 is interposed between the yarn detector 33 and one of the switch levers 36. As illustrated in FIG. 3, each of the switch levers 36, 36 has a guide slot 37 and an escape slot 38 contiguous thereto, the guide slot 37 being positioned to cause a yarn therein to pass through the yarn detector 33.

Figure 4:
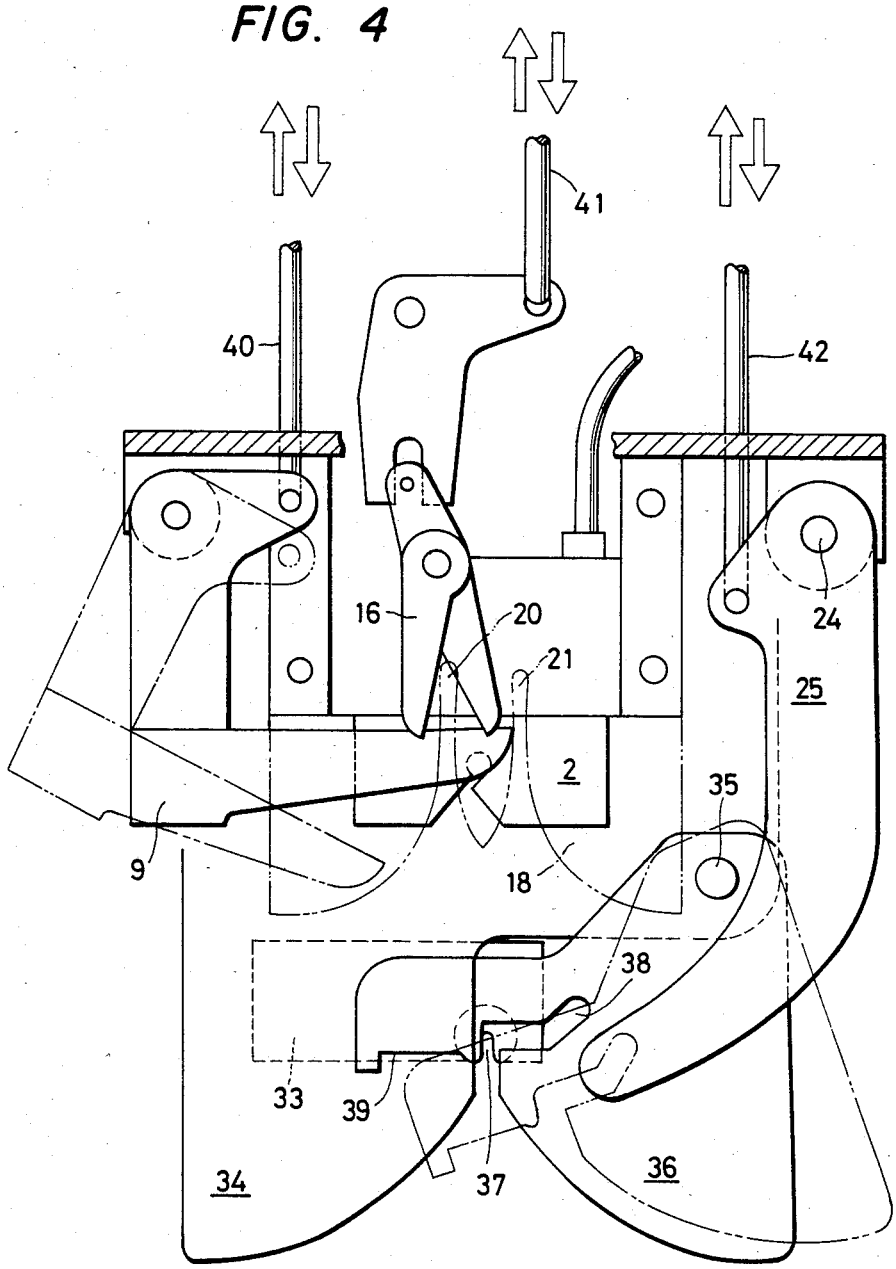

Operation of the yarn splicing device 1 thus constructed will be described. When the detector 33 detects that no yarn is running due to a breakage in a yarn being wound or an empty bobbin, the winding operation is stopped for yarn splicing operation. A pair of package and bobbin suction arms 44, 43 (FIG. 1) attract the yarn ends YP, YB, respectively, and turn around to introduce the yarn ends YP, YB into the yarn splicing device 1. The suction arms 44, 43 do not turn around at the same time. More specifically, the yarn end YP is first carried by the package suction arm 44 under suction and travels along a curved path to a position outside of the yarn splicing device 1, in which the yarn end YP is stopped. Then, upon elapse of a certain period of time, the yarn end YB is carried by the bobbin suction arm under suction and moves to a position outside of the yarn splicing device 1, in which the yarn end YB is stopped. After the package suction arm 44 has been actuated and before the bobbin suction arm 43 is operated, the swing lever 28 of the clamp unit 27 is actuated to guide the yarn end YP between the swing lever 28 and the clamp plate 29 and then into the fixed guide plate 34 and the guide slots 37 in the switch levers 36 located adjacent to the yarn detector 33, as shown in FIGS. 3 and 4. The yarn end YP is checked by the yarn detector 33, and then the switch levers 36 are angularly moved about the pivot shaft 35 to the two-dot-and-dash lines as shown in FIG. 4 to displace the yarn end YP from the yarn detector 33 into the escape slots 38. Thereafter, the bobbin suction arm 43 draws the yarn end YB under suction and is swung to the position outside of the yarn splicing device 1. At this time, the yarn end YB is guided by hooks 39 on the switch levers 36 into a position between the lever 31 and clamp plate 32 of the clamp unit 30.

After the operation of the bobbin and package suction arms 43, 44 has been completed, the yarn handler levers 25, 25 are turned about the support shaft 24 to guide the yarn end YB into a guide slot 20 in the fork guide 18, the yarn splicing hole 5 in the yarn splicing member 2, a gap between the yarn guides 14, 15, and a guide 19, and also to guide the yarn end YP into a guide slot 21 in the fork guide 18, a gap between the yarn guides 12, 13, the yarn splicing hole 5 in the yarn splicing member 2, and a guide slot 23 in the fork guide 19, as shown in FIG. 2. Subsequently, the swing lever 28 of the clamp unit 27 is pressed against the clamp plate 29 to clamp the yarn end YP in position, and the clamp plate 32 of the clamp unit 30 is pressed against the lever 31 to clamp the yarn end YB in position.

Figure 7:
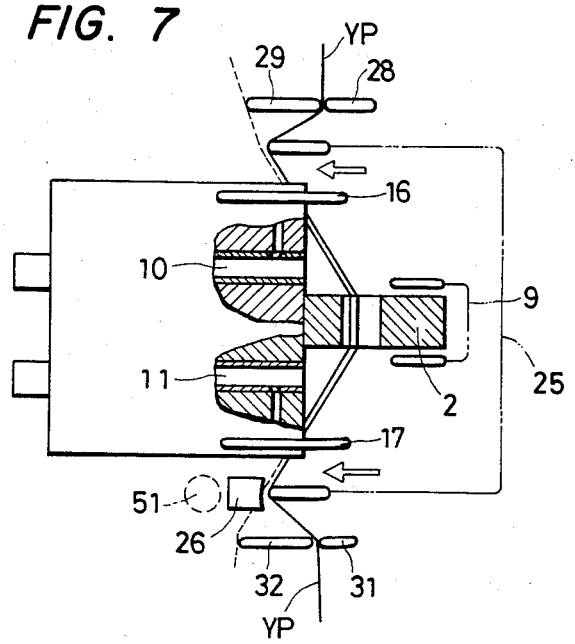
FIGS. 7 through 9 are side elevational views partly in section showing the spun yarn splicing device.

Then, as shown in FIG. 2, the yarn ends are severed by the yarn cutters 16, 17 at positions spaced from the clamp units 30, 27, whereupon the parts of the yarn splicing device 1 are positioned as shown in FIG. 7.

Figure 8:
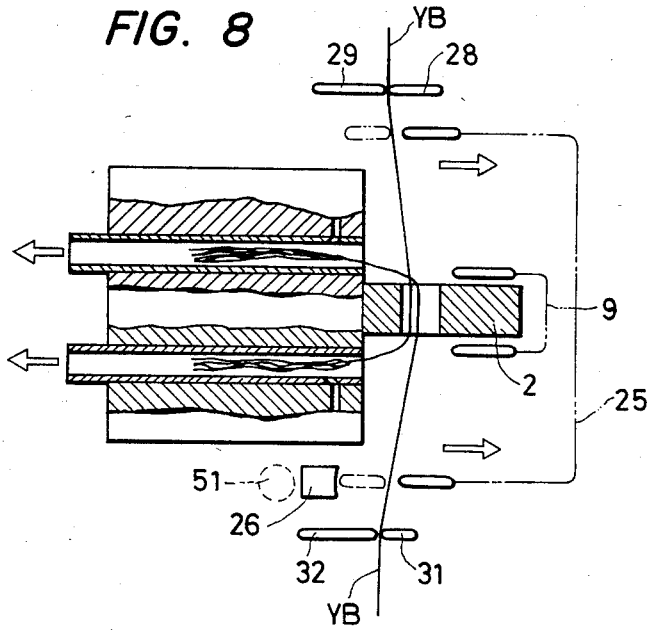

Substantially at the same time that the yarn ends are cut off, the control nozzles 10, 11 are put into operation to draw the yarn ends under suction as shown in FIG. 8. Thereafter, the swing levers 25, 25 are retracted to allow the yarn ends to be drawn further into the control nozzles 10, 11. Suction is developed in the control nozzle 10 by a vacuum in the flexible pipe 48 connected thereto. Simultaneously, compressed fluid is ejected from the fluid ejection aperture 49 into the nozzle pipe 47 to untwist and loosen the yarn end in the nozzle pipe 47. The flexible pipe 48 may be dispensed with as a stream of air flows in the opening of the nozzle pipe 47 for drawing the yarn end due to the compressed fluid ejected from the fluid ejection aperture 49.

Figure 6A:
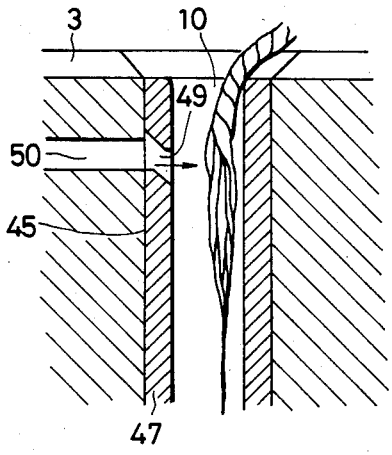
FIGS. 6-*a* through 6-*c* are enlarged cross-sectional view of the control nozzle.
Figure 6B:
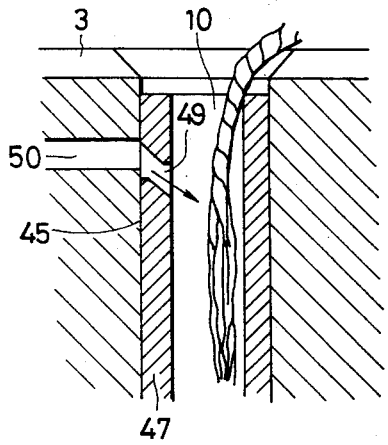
Figure 6C:
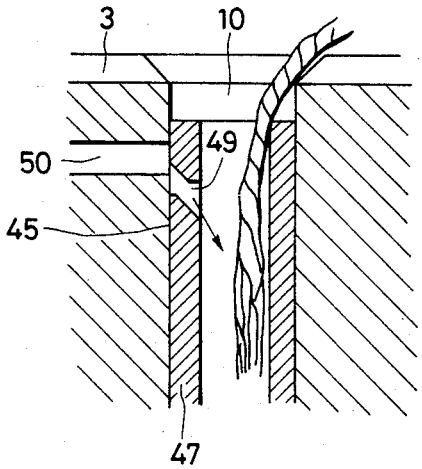

As illustrated in FIGS. 6-*a* through 6-*c*, the nozzle pipe 47 is axially movably inserted in the nozzle hole 45. By adjusting the axial position of the nozzle pipe 47 in the nozzle hole 45, the direction of flow of the compressed fluid as ejected from the fluid ejection aperture 49 can be changed to vary the position in which the compressed fluid flow hits the yarn end introduced in the nozzle pipe 47, thereby changing the length and degree by which the yarn end is untwisted. The yarn end can be untwisted well when the nozzle pipe 47 is positioned with respect to the nozzle hole 45 as shown in FIG. 6-*b*. When the nozzle pipe 47 is positioned as shown in FIG. 6-*a*, the stream of compressed fluid impinges upon a relatively upper portion of the yarn end to untwise the latter for an increased length, resulting in a progressively narrower yarn end. A yarn joint made of such yarn ends is unsightly and has pills. When the nozzle pipe 47 is pushed into the nozzle hole 45 as illustrated in FIG. 6-*c*, the compressed fluid flow hits the distal end of the yarn end in the nozzle pipe 47 with the result that the untwisted length of the yarn end is relatively small and the resultant yarn joint is weak and thick. The nozzle pipe 47 can be adjusted in axial position for the best untwisted yarn conditions dependent on the kind and yarn count of the yarn being used.

Figure 9:
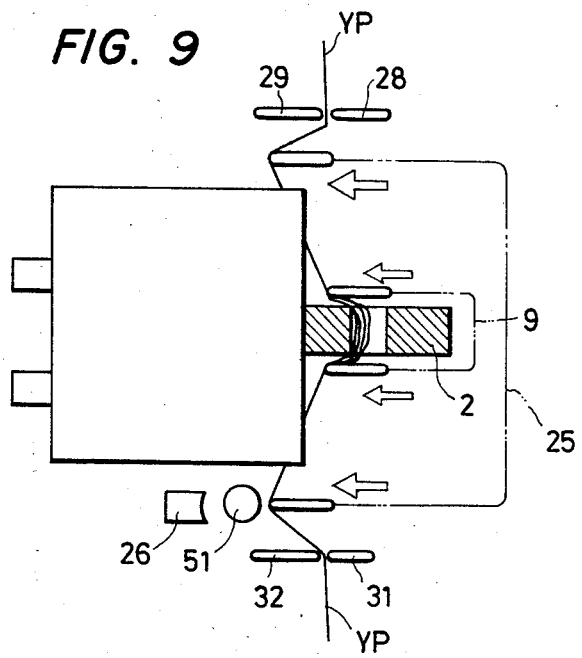
Figure 10:
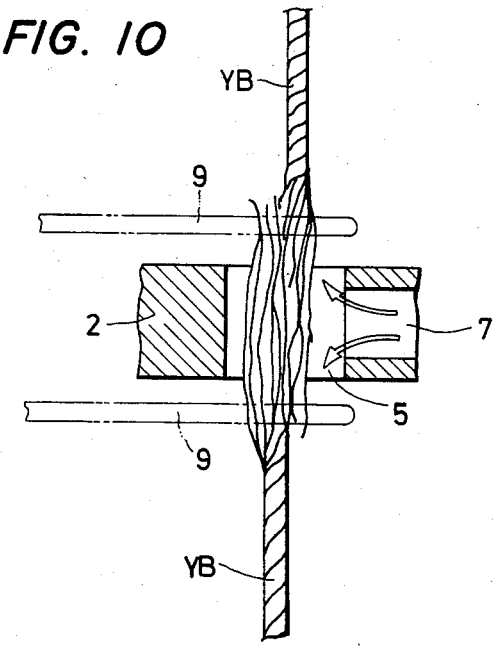
FIG. 10 is a fragmentary enlarged cross-sectional view of the spun yarn splicing device illustrated in FIG. 9.
Figure 11:
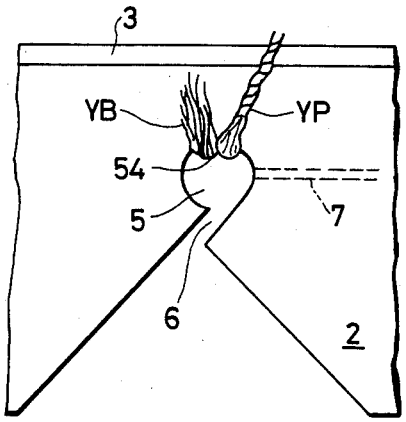
FIG. 11 is an enlarged front elevational view of a yarn splicing hole.

At the same time or substantially at the same time that the control nozzles 10, 11 stop drawing in the yarn ends YB, YP after the latter have been untwisted therein to a degree suitable for yarn splicing the yarn handler levers 25 move forward again as shown in FIG. 9 to guide the yarn ends YP, YB until one of them is brought into abutment against a positionally adjustable stopper 51 which replaces the stopper 26 that has been retracted. Concurrent with this, the yarn presser levers 9 are actuated to approach the surface of the bracket 3 while guiding the yarn ends YP, YB for bending the yarn ends at the open ends of the yarn splicing hole 5 until the yarn ends are positioned in mutual contact in overlapped relation at a location that is diametrically opposite to the slit 6, as shown in FIGS. 11, 12. In this manner, the untwisted yarn ends YB, YP are drawn out of the control nozzles 10, 11 and introduced into the yarn splicing hole 5.

The stopper 51 is adjustably movable in the back and forth direction. By changing the position of the stopper 51, the length of the yarn ends YB, YP as drawn out of the control nozzles 10, 11 can be changed and hence the length by which the yarn ends YB, YP are overlapped can be varied.

Figure 13:
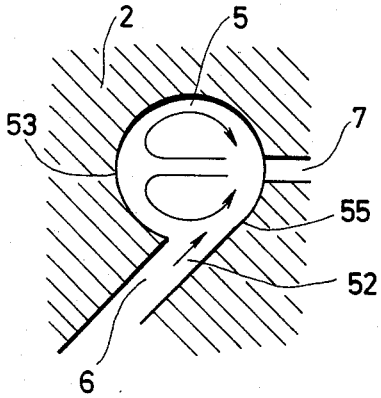
Figure 14:
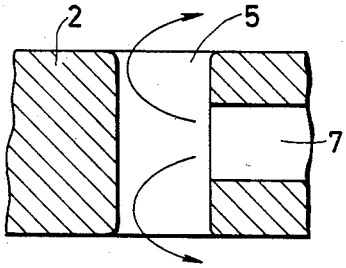

Then, the compressed fluid is ejected from the fluid ejection nozzle 7 as swirling streams which are discharged out of the open ends of the yarn splicing hole 5 as shown in FIGS. 13, 14. A swirl of fluid flowing along the inner peripheral wall of the yarn splicing hole 5 develops a vacuum in the slit 6 adjacent to the yarn splicing hole 5 for thereby inducing a stream of fluid 52 flowing into the yarn splicing hole 5.

Figure 15:
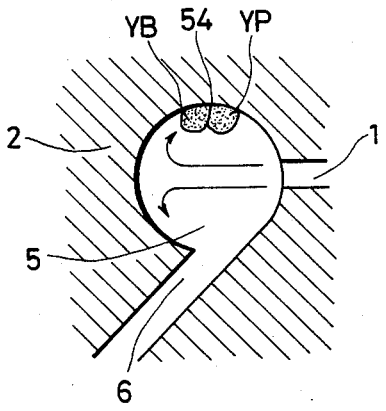

As illustrated in FIGS. 13 and 15, the flow of compressed fluid as ejected from the fluid ejection nozzle 7 reaches a wall surface 53 of the yarn splicing hole 5 which faces in diametrically opposite relation to the nozzle 7, and flows along the inner peripheral surface of the yarn splicing hole 5 to the yarn ends YB, YP whereupon fibers of the yarn ends are caused by such fluid flow to be twined together at their mutually contacting portion 54 during an initial stage. Such intertwined fibers allow the yarn ends YB, YP to become united progressively while they are moved around in the yarn splicing hole 5 under the force of the compressed fluid introduced therein, during which time the yarn ends are intertwined further. The intertwined fibers are important because if the compressed fluid were blown against the yarn ends YB, YP as they are separated in the yarn splicing hole 5, they could not be twined together at the initial stage, and would move independently in the yarn splicing hole 5, with the consequence that the yarn ends YB, YP would be forced out of the open ends of the yarn splicing hole 5.

Figure 16:
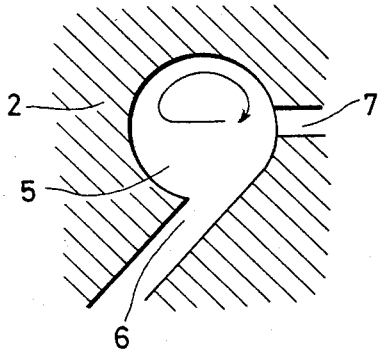
Figure 17:
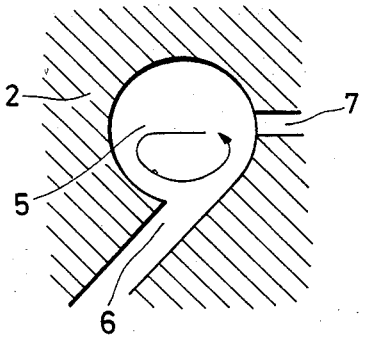
Figure 18:
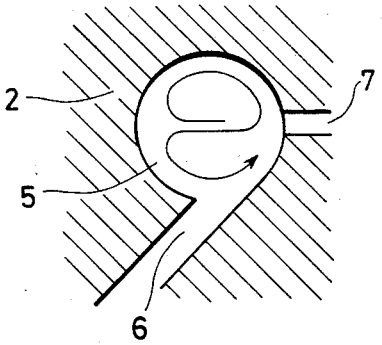

The yarn ends YB, YP which have been intertwined and joined at the initial stage are not highly tensioned but relatively loose, and move around in the yarn splicing hole 5 due to the ejected fluid flow along a path as shown in FIG. 16, FIG. 17 or FIG. 18. The movement of the yarn ends along the paths as illustrated in FIGS. 16 through 18 are each composed of a straight motion diametrically across the yarn splicing hole 5 and a semicircular motion along the inner peripheral surface of the yarn splicing hole 5. When the yarn ends move diametrically across the yarn splicing hole 5, they are subjected to direct contact with the stream of compressed fluid as ejected from the fluid ejection hole 7, and therefore their fibers are mixed together and intertwined strongly. During circular movement, the yarn ends are brought into contact with the wall surface of the yarn splicing hole 5 to cause their outer fibers to be intertwined and prevent fibers from protruding outwardly, at random. Accordingly, the yarn ends YB, YP can be joined into a yarn joint which is sightly and has a tensile strength comparable to that of the rest of the yarn.

The yarn joint thus obtained according to the present invention is slightly poor in appearance as compared with those yarn joints which are prepared only by turning yarn ends around in a cylindrical yarn splicing hole on a stream of compressed fluid swirling simply along the inner wall of the yarn splicing hole. However, the yarn joint made according to the present invention has a higher tensile strength, an advantage especially for yarns of larger yarn counts such as 20 Nm, 10 Nm which need sufficiently intertwined yarn fibers when to be spliced together.

The reason for the elongated cross-sectional shape of the fluid ejection nozzle 7 in the axial direction of the yarn splicing hole 5 is to enable the ejected fluid flow to act on substantial portion of the yarn joint without increasing the amount of fluid being ejected from the fluid ejection nozzle 7. If the fluid were ejected in too a large amount, it would be discharged out of the open ends of the yarn splicing hole 5, a condition which is not suitable for splicing the yarn ends together.

The slit 6 directed tangentially to the yarn splicing hole 5 allows the joined yarn ends to be more easily taken out than would be if the slit 6 were directed to the central axis of the yarn splicing hole 5. With the fluid ejection nozzle 7 being opened adjacent to the junction 55 between the slit 6 and the yarn splicing hole 5, as shown in FIG. 13, no fluid flows out through the slit 6 but rather the stream of fluid 52 flows through the slit 6 into the yarn splicing hole 5. Therefore, there is no tendency for the yarn ends to be forced out through the slit 6 while they are being spliced together.

When the yarn ends YB, YP have been spliced together, the joined yarn ends are released from the clamp units 27, 30, and the yarn presser levers 9 and the yarn handler levers 25 are retracted, whereupon the yarn is released from the yarn splicing device 1 and starts to be wound again in a normal yarn winding position.

With the arrangement of the present invention, as described above, the yarn splicing device 1 having the yarn splicing member 2 allows fibers of yarn ends to be intertwined strongly by a stream of compressed fluid directly hitting the yarn ends in the yarn splicing hole 5, and employs a swirling flow of fluid to prevent fiber ends from protruding at random at the yarn joint. The yarn joint produced according to the present invention has a strength comparable to that of the rest of the yarn.

Although a certain preferred embodiment has been shown and described, it should be understood that many changes and modifications may be made therein without departing from the scope of the appended claim.

What is claimed is:

1. A spun yarn splicing device comprising a yarn splicing member having a body with opposed sides, the splicing member body including a yarn splicing hole extending between said opposed sides, a fluid ejection nozzle for ejecting compressed fluid into said yarn splicing hole, the fluid ejection nozzle opening into the yarn splicing hole, and a slit opening into said yarn splicing hole for guiding untwisted yarn ends to be spliced into said yarn splicing hole, said yarn splicing hole being circular in cross section, said slit being directed tangentially to said yarn splicing hole and connected thereto at a junction, wherein said fluid ejection nozzle opens toward a central axis of said yarn splicing hole, wherein the opening of the fluid ejection nozzle has a cross-sectional shape elongated in an axial direction of said yarn splicing hole, wherein the device further includes initial positioning means for initially positioning untwisted yarn ends to be spliced within said yarn splicing hole diametrically opposite the tangential slit and away from the linear direction of travel of the fluid so that the initial contact of the fluid with the yarn ends to be spliced is from a stream of fluid deflected from the portion of the wall of the splicing hole opposite the fluid ejection nozzle opening, and whereby the yarn ends in said yarn splicing hole can be spliced together by introducing the compressed fluid from said fluid ejection nozzle into said yarn splicing hole.

2. A spun yarn splicing device as claimed in claim 1, wherein a yarn presser lever is disposed adjacent each side of the yarn splicing member for positioning yarn ends in mutual contact within said yarn splicing hole in diametrically opposite relation to the slit.

3. A spun yarn splicing device as claimed in claim 2, wherein on both sides of said yarn spicing member there are further provided a pair of control nozzles for untwisting cut yarn ends to be spliced, yarn guides for guiding the yarn to be cut and untwisted, a pair of cutters for cutting the twisted yarn prior to operation of the control nozzles, a pair of fork guides for guiding the yarn to the cutters, a pair of swingable yarn handler levers for drawing the cut, untwisted yarn ends to be spliced from the control nozzles to the yarn splicing hole, and a pair of clamp units comprising a lever and a clamp plate, said yarn handler levers being fixed to a support shaft at its ends alongside of the yarn splicing member.

4. A spun yarn splicing device as claimed in claim 3, wherein each of said control nozzles comprises a body having a nozzle hole, a nozzle pipe being axially insertable in the nozzle hole, and a fluid ejection aperture provided in a side of the nozzle pipe, the aperture allowing compressed fluid to pass into the nozzle pipe, a yarn end to be spliced being untwisted to a desirable length and degree by adjusting the axial position of the nozzle pipe in the nozzle hole.

5. A spun yarn splicing device as claimed in claim 3, wherein stoppers being adjustably movable and being brought into abutment against said yarn handler levers are further provided to vary the length of the yarn ends which are drawn out of the control nozzles by the yarn handler levers and to position said yarn ends in the yarn splicing hole in an overlapped relation.

6. A device for splicing yarn, the device being a component of a pneumatic spun yarn splicing apparatus, the device comprising:

a yarn splicing member having a body with a pair of opposed sides, the splicing member body including:

a splicing hole for splicing yarn ends, the splicing hole extending between the opposed sides and having a circular cross section;

a slit for guiding yarn ends to be spliced into the yarn splicing hole, the slit communicating with the splicing hole by opening into the splicing hole in a direction tangential to the splicing hole and extending between the opposed sides of the splicing member body; and a fluid ejection nozzle for ejecting compressed fluid into the splicing hole, the fluid ejection nozzle located between the opposed sides and opening into the splicing hole in a direction normal to the surface defining the splicing hole; and initial positioning means for initially positioning the yarn ends to be spliced within the yarn splicing hole diametrically opposite the tangential slit and away from the linear direction of travel of the fluid so that the initial contact of the fluid with the yarn ends to be spliced is from a stream of fluid deflected from the portion of the wall of the splicing hole opposite the fluid ejection nozzle opening, wherein overlapped yarn ends located in the splicing hole can be spliced together by ejecting compressed fluid through the fluid ejection nozzle and into the splicing hole.

7. A device for splicing yarn according to claim 6 wherein the fluid ejection nozzle opening has a cross section elongated in the direction of the axis of the splicing member body.

8. A device for splicing yarn, the device being a component of a spun yarn splicing apparatus, the device comprising:

a yarn splicing member having a body with a pair of opposed sides, the splicing member body including:

a splicing hole for splicing yarn ends, the splicing hole extending between the opposed sides and having a circular cross section;

a slit for guiding yarn ends to be spliced into the yarn splicing hole, the slit extending between the opposed sides and opening into the splicing hole in a direction tangential to the splicing hole; and a fluid ejection nozzle for ejecting compressed fluid into the splicing hole, the fluid ejection nozzle opening into the splicing hole so that compressed fluid ejected from the nozzle flows in a generally straight direction until the fluid contacts the inner wall of the splicing hole diametrically opposite the fluid ejection nozzle opening at which point the fluid diverges into two generally semicircular fluid flow patterns which converge adjacent to the fluid ejection nozzle opening, whereby the overlapped portion of the yarn ends is subjected to both the straight flow of compressed fluid and a semicircular flow of compressed fluid; and initial positioning means for initially positioning the yarn ends to be spliced within the yarn splicing hole diametrically opposite the tangential slit and away from the straight direction of travel of the fluid so that the initial contact of the fluid with the yarn ends to be spliced is from a semi-circular stream of fluid.

* * * * *